US010723416B2

(12) United States Patent
Knutsen et al.

(10) Patent No.: US 10,723,416 B2
(45) Date of Patent: Jul. 28, 2020

(54) MOORING FRAME FOR MOORING A FLOATING UNIT AND A FLOATING UNIT COMPRISING SUCH A MOORING FRAME

(71) Applicant: Connect LNG AS, Oslo (NO)

(72) Inventors: David Mikal Knutsen, Oslo (NO); Stian Tunestveit Magnusson, Oslo (NO)

(73) Assignee: Connect LNG AS, Oslo (NO)

( * ) Notice: Subject to any disclaimer, the term of this patent is extended or adjusted under 35 U.S.C. 154(b) by 0 days.

(21) Appl. No.: 16/324,578

(22) PCT Filed: Aug. 18, 2017

(86) PCT No.: PCT/EP2017/070926
§ 371 (c)(1),
(2) Date: Feb. 11, 2019

(87) PCT Pub. No.: WO2018/033623
PCT Pub. Date: Feb. 22, 2018

(65) Prior Publication Data

US 2019/0217928 A1 Jul. 18, 2019

(30) Foreign Application Priority Data

Aug. 19, 2016 (NO) ..... 20161328

(51) Int. Cl.
*B63B 27/30* (2006.01)
*B63B 21/00* (2006.01)

(52) U.S. Cl.
CPC ..... *B63B 27/30* (2013.01); *B63B 21/00* (2013.01); *B63B 2021/006* (2013.01)

(58) Field of Classification Search
CPC ..... B63B 21/00; B63B 21/02; B63B 21/06; B63B 27/00; B63B 27/24; B63B 27/30; B63B 27/34
(Continued)

(56) References Cited

U.S. PATENT DOCUMENTS 6,227,135 B1 * 5/2001 Pedersen ..... B63B 21/06 114/230.15
6,938,570 B2 * 9/2005 Montgomery ..... B63B 21/00 114/230.1
(Continued)

FOREIGN PATENT DOCUMENTS

WO WO02/090176 A 11/2002
WO WO2005/097590 10/2005
(Continued)

*Primary Examiner* — Lars A Olson
(74) *Attorney, Agent, or Firm* — Christian D. Abel

(57) ABSTRACT

A mooring frame (26, 27) for mooring of a floating unit (10), the mooring frame (26, 27) being adapted for mounting on the floating unit (10) or a floating or non-floating structure and comprising an attachment unit (30) for attachment to the floating unit (10) or the floating or non-floating structure. The mooring frame (26, 27) further comprises a first mooring unit (40) for transferring forces and/or absorbing energy in a first direction, and a second mooring unit (50) for transferring forces and/or absorbing energy in a second direction which is at least partially perpendicular to the first direction, wherein—the first mooring unit (40) and the second mooring unit (50) are attached to each other with a joint element (51) which allows relative rotation about two or three independent axes, —the attachment unit (30) is attached to the mooring frame (26, 27) with a joint element (41) which allows relative rotation about three independent axes, —the first mooring unit (40) is adapted to be attached to the floating unit (10) or the floating or non-floating structure with a joint element (20) which allows relative rotation about two or three independent axes, and—the second mooring unit (50) is adapted to be attached to the floating unit (10) or the floating or non-floating structure with a joint element (22) which allows relative rotation about two or three independent axes. At least one of the joint element (20) and the joint element (41) or joint element (51) allows torsional movement of the first mooring unit (40) relative to the floating unit (10) or the floating or non-floating structure, or torsional movement is allowed within the first mooring unit (40) itself, and at least one of the joint
(Continued)

element (22) and the joint element (51) or joint element (41) allows torsional movement of the second mooring unit (50) relative to the floating unit (10) or the floating or non-floating structure, or torsional movement is allowed within the second mooring unit (50) itself.

20 Claims, 14 Drawing Sheets

(58) Field of Classification Search
USPC ..... 114/230.1, 230.15
See application file for complete search history.

(56) References Cited

U.S. PATENT DOCUMENTS 8,215,256 B2 * 7/2012 Montgomery ..... B63B 21/00 114/230.1
8,408,153 B2 * 4/2013 Montgomery ..... E02B 3/20 114/230.1
9,387,909 B2 * 7/2016 Boerleider ..... B63B 21/02
9,446,820 B2 * 9/2016 Boerleider ..... B63B 21/02
2003/0226487 A1 * 12/2003 Boatman ..... B63B 21/00 114/230.15
2004/0025772 A1 * 2/2004 Boatman ..... B63B 27/24 114/230.15
2004/0182296 A1 * 9/2004 Montgomery ..... B63B 21/00 114/230.1
2006/0081166 A1 * 4/2006 Montgomery ..... B63B 21/00 114/230.1
2006/0233629 A1 * 10/2006 Naciri ..... B63B 27/24 414/137.9

FOREIGN PATENT DOCUMENTS

WO WO2009/041834 A 4/2009
WO WO2009/048342 4/2009

* cited by examiner

MOORING FRAME FOR MOORING A FLOATING UNIT AND A FLOATING UNIT COMPRISING SUCH A MOORING FRAME

The present invention is related to a mooring frame for mooring a floating unit and a floating unit comprising such a mooring frame.

Transfer of temperate fluids from ship to shore is today achieved, among other methods, through a submerged flexible hose, which is lifted from the seabed and connected directly to the vessel manifold. To avoid excessive heat loss and accumulation of an external ice layer, the transfer of cryogenic liquids through any pipe in contact with water requires the pipe to be extensively insulated, resulting in considerably larger weight per meter than pipes for transfer of temperate fluids. The handling of pipes for cryogenic applications will therefore often be unmanageable for the ship's lifting equipment and manifold. Furthermore, the transfer of cryogenic liquids requires precooling of transfer ducts to avoid extensive vapor generation. The precooling must be conducted immediately prior to the transfer operation, and the operation must commence shortly after arrival of the distribution carrier for cost efficient shipping. Moreover, the handling of many cryogenic fluids requires the implementation of special measures to minimize the risk of a spill in any event of default. Emergency shut down systems, emergency release couplings, and special monitoring systems are often a profound integration of a cryogenic transfer operation.

The use of loading systems comprising various types of floating concepts are known in the offshore petroleum industry. Environmental conditions offshore are often harsh, which significantly increases the requirements and cost for systems to operate in these conditions.

To overcome at least some of the problems of the prior art, a floating unit for transfer of a fluid or electric power between a floating structure and a floating or non-floating structure has been proposed and described in the publication WO 2015/107147 A1. There is, however, a need for further improvement of the mooring system that moors the floating unit to the floating or non-floating structure which is disclosed in this publication.

Known mooring systems are disclosed in the publications US 2005/097590 A1, US 2004/154518 A1 and WO 2009/048342 A2.

An objective of the present invention has been to provide a mooring system for mooring a floating unit to a floating or non-floating structure that allows vertical translational motion and rotational motion about any horizontal axis of the floating unit relative to the floating or non-floating structure while lateral translational motion and rotational motion about a vertical axis of the floating unit relative to the floating or non-floating structure is substantially restricted.

Another objective has been to make it possible with a close mooring distance between a floating unit and a floating or non-floating structure also when there is a large freeboard difference between.

Another objective has been to obtain a mooring system that provides a robust and reliable connection between the floating unit and the floating or non-floating structure to which the floating unit is moored.

Another objective has been to obtain a mooring system with low manufacturing and installation costs and low maintenance costs.

These objectives are achieved by a mooring frame as defined in claim 1, a floating structure as defined in claim 15, and use of the mooring frame as defined in claims 21 and 22.

The independent claims define further embodiments of mooring frame and the floating structure.

The mooring frame disclosed herein can be used to temporarily moor a floating unit, such as a vessel or a platform, to another floating or non-floating unit, vessel or structure. The mooring frame absorbs forces and energy that arise from relative motions between the floating unit and the floating or non-floating structure. The forces and energy that arises from relative motions taking place in two main directions in a horizontal plane, a first direction and a second direction, which are typically the x-direction and y-direction in a Cartesian coordinate system, are absorbed by the mooring frame.

Typically two mooring frames may be used to moor the floating unit which are connected to the floating unit or to the floating or non-floating unit, vessel or structure with a joint that allows rotational motion about three independent axes, for example universal joints. The frames are provided with vacuum pads or electromagnetic pads for temporary mooring of the floating unit to the floating or non-floating unit or vessel and thereby transferring loads that arise from the relative motion. The mooring frames may be provided with mooring units and support elements that absorb energy from relative translational motion in the horizontal plane by using integrated stiffness elements, for example spring elements. Damping elements may also be included if that is required.

There is provided a mooring frame for mooring of a floating unit, the mooring frame being adapted for mounting on the floating unit or a floating or non-floating structure and comprising an attachment unit for attachment to the floating unit or the floating or non-floating structure. The mooring frame further comprises a first mooring unit for transferring forces and/or providing restoring forces and/or absorbing energy in a first direction, and a second mooring unit for transferring forces and/or providing restoring forces and/or absorbing energy in a second direction which is at least partially perpendicular to the first direction, wherein

- the first mooring unit and the second mooring unit are attached to each other with a joint element which allows relative rotation about two or three independent axes,
- the attachment unit is attached to the mooring frame with a joint element which allows relative rotation about three independent axes,
- the first mooring unit is adapted to be attached to the floating unit or the floating or non-floating structure with a joint element which allows relative rotation about two or three independent axes, and
- the second mooring unit is adapted to be attached to the floating unit or the floating or non-floating structure with a joint element which allows relative rotation about two or three independent axes.

The term "partially perpendicular" in a given direction should be understood herein, in connection with the present invention, as having a first component perpendicular to said direction and a second component parallel to said direction. The phrase above stating that the second direction is " . . . at least partially perpendicular . . . " to a first direction should therefore be understood such that the second direction at least has a component that is perpendicular to the first direction and possibly it is the only component and the second direction is perpendicular to the first direction. In practice that means that the second direction is at angle relative to the first direction that is larger than zero degrees, and preferably the angle between the second direction and the first direction will be closer to ninety degrees than zero degrees.

At least one of the joint elements through which the longitudinal axis of the first mooring unit passes allows torsional movement of the first mooring unit relative to the floating unit or the floating or non-floating structure, or torsional movement is allowed within the first mooring unit itself, and at least one of the joint elements through which the longitudinal axis of the second mooring unit passes allows torsional movement of the second mooring unit relative to the floating unit or the floating or non-floating structure, or torsional movement is allowed within the second mooring unit itself.

The first direction and the second direction may conveniently be taken as the x-direction and the y-direction respectively in a Cartesian coordinate system where the x-axis and the y-axis form a substantially horizontal plane. During use, the position of the first mooring unit and the second mooring unit relative to each other and to the floating unit will continuously change slightly due to relative movements between the floating unit and the floating or non-floating structure to which the floating unit is connected.

The first mooring unit may comprise a cylinder/piston assembly with a cylinder and a piston movably arranged in the cylinder where the cylinder/piston assembly make up the major part of the first mooring unit. Alternatively, the first mooring unit may comprise a beam or a truss element and in addition a cylinder/piston assembly.

Furthermore, the first mooring unit may comprise a spring element and/or a shock absorbing element in order to absorb forces and energy arising from relative motion between the floating unit and the floating or non-floating structure that the floating unit is moored to. The first mooring unit is preferably arranged with a double-acting cylinder/piston assembly, i.e. the first mooring device damps movements both when the piston is moving into the cylinder and when the piston is moving out of the cylinder, or with two single-acting cylinder/piston assemblies arranged such that they damp movements in opposite directions. Alternatively the first mooring device is provided with just one single-acting cylinder/piston assembly only which damps movements in one direction only.

The second mooring unit preferably comprises a cylinder/piston assembly with a cylinder and a piston movably arranged in the cylinder. Furthermore, the second mooring unit preferably comprises a spring element and/or a shock absorbing element in order to absorb forces and energy arising from relative motion between the floating unit and the floating or non-floating structure that the floating unit is moored to. The second mooring unit is preferably arranged with a double-acting cylinder/piston assembly, i.e. the second mooring device damps movements both when the piston is moving into the cylinder and when the piston is moving out of the cylinder, or with two single-acting cylinder/piston assemblies arranged such that they damp movements in opposite directions. Alternatively the second mooring device is provided with just one single-acting cylinder/piston assembly only which damps movements in one direction only.

Together, the first mooring unit and the second mooring unit transfer forces and absorb energy arising from substantially horizontal components of movements caused by the relative motion between the floating unit and the floating or non-floating structure.

If deemed necessary, the mooring frame may further comprise a frame support unit. The frame support unit may be connected to the first mooring unit or the second mooring unit with a joint element which allows the frame support unit to rotate about three independent axes relative to the one of the first mooring unit and the second mooring unit to which it is connected.

The frame support unit will help to keep the mooring frame in its position vertically. The frame support unit may also be used for damping of movements in a third direction which is at least partially perpendicular to the first direction and the second direction. The third direction may be taken to be the z-direction in a Cartesian coordinate system where the z-direction is perpendicular to the plane formed by the x-direction and y-direction mention above.

If included in the mooring frames, the frame support unit may comprise a winch with a winch wire. Alternatively the frame support unit may comprise two or more telescoping elements to obtain a variable length of the frame support unit. Alternatively, the frame support unit may comprise a cylinder/piston assembly with a cylinder and a piston movably arranged in the cylinder. The telescoping elements or the cylinder/piston assembly may be provided with a spring element in order to help keep the mooring frame in a substantially horizontal position and prevent it from falling down when the attachment unit is not attached to any floating or non-floating structure. The frame support unit may also comprise a shock absorbing element to damp vertical oscillating motions of mooring frame. The telescoping elements or the cylinder/piston assembly may also be hydraulically operated to obtain the necessary support to keep the mooring frame in a substantially horizontal position and/or to obtain any desired or required damping of vertical motions.

The cylinder/piston assembly of the frame support unit may be designed as a double-acting unit, i.e. the frame support unit is designed such that forces and energy are absorbed both when the piston is moving into the cylinder and when the piston is moving out of the cylinder due to relative motion between the floating unit and the floating and/or non-floating unit on which the mooring frame is mounted. Alternatively, the cylinder/piston assembly may be designed as a single-acting cylinder/piston assembly only which damps vertical movements in one direction only, for example when the first mooring unit is moving upwards compressing the cylinder/piston assembly of the frame support unit.

The attachment unit preferably comprises a support frame and at least one, but preferably a plurality of attachment elements mounted to the support frame with a joint element which allows the at least one attachment element to rotate about three independent axes relative to the support frame. The attachment elements are preferably a vacuum pad, an electromagnetic pad or any other suitable element that is capable of detachably attaching itself to the outer surface of a floating or non-floating structure. The attachment unit preferably also comprises a fender or a rotation limiter that limits the movement of the at least one attachment element relative to the support frame.

The mooring frame further preferably comprises at least one support element, but preferably two or three support elements, for damping of movements of the attachment unit relative to the one of the first mooring unit and the second mooring unit that the at least one support element is connected to such that the attachment unit maintains its original position before and after attachment to an outer surface of the floating or non-floating structure. The at least one support element is preferably connected to the attachment unit with a joint element which allows the at least one support element to rotate about three independent axes relative to the attachment unit and to the first mooring unit or the second mooring unit with a joint element which allows the at least one support element to rotate about three independent axes relative to the first mooring unit or second mooring unit depending on which of the two mooring units it is connected to.

The at least one support element for the attachment unit preferably comprises a cylinder/piston assembly with a cylinder and a piston movably arranged in the cylinder. Furthermore, the at least one support element preferably comprises a spring element and/or a shock absorbing element in order to maintain a level position of the attachment frame before and after engagement of the at least one attachment element. The at least one support element may be arranged with a double-acting cylinder/piston assembly, i.e. the at least one support element damps movements and provides a spring restoring force both when the piston is moving into the cylinder and when the piston is moving out of the cylinder, or with two single-acting cylinder/piston assemblies arranged such that they damp movements and provides a spring restoring force in opposite directions. Alternatively the at least one support element may be provided with just one single-acting cylinder/piston assembly only which damps movements and provides a spring restoring force in one direction only, for example as the cylinder/piston assembly is compressed.

The attachment unit may further comprise an independent shock absorbing element for absorbing impact energy during attachment of the attachment elements to an outer surface of the floating or non-floating structure where the shock absorbing element works independently of attachment elements. That the shock absorbing element is independent means that it works independently of the attachments elements. The shock absorbing element may comprise a hydraulic piston, a pneumatic piston, a fender or any other suitable device that is capable of absorbing impact energy during attachment of the floating unit to the floating or non-floating unit.

The first mooring unit is preferably adapted to be further connected to a structure that the mooring frame is being mounted on, for example a floating unit or a floating or non-floating structure, with a joint element which allows the first mooring unit to rotate about three independent axes relative to the structure.

The second mooring unit is preferably also adapted to be further connected to a structure that the mooring frame is being mounted on, for example a floating unit or a floating or non-floating structure, with a joint element which allows the second mooring unit to rotate about three independent axes relative to the structure.

The frame support unit is preferably also adapted to be further connected to a structure that the mooring frame is being mounted on, for example a floating unit or a floating or non-floating structure, with a joint element which allows the frame support unit to rotate about three independent axes relative to the structure.

The joint element connecting the first mooring unit to the attachment unit or the second mooring unit is preferably a universal joint or a ball joint or any other suitable joint device that is capable of allowing the first mooring unit to rotate about three independent axes, for example x-direction, y-direction and z-direction in the Cartesian coordinate system, relative to the one of the attachment unit and the first mooring unit to which it is connected.

The joint element connecting the second mooring unit to the first mooring unit or the attachment unit preferably also comprises a universal joint or a ball joint or any other suitable joint device that is capable of allowing the second mooring unit to rotate about three independent axes, for example x-direction, y-direction and z-direction in the Cartesian coordinate system, relative to the one of the first mooring unit and the attachment unit to which it is connected.

The joint element connecting the frame support unit to the first mooring unit or the second mooring unit preferably also comprises a universal joint or a ball joint or any other suitable joint device that is capable of allowing the frame support unit to rotate about three independent axes, for example x-direction, y-direction and z-direction in the Cartesian coordinate system, relative to the one of the first mooring unit and the second mooring unit to which it is connected.

The first mooring unit, the second mooring unit, the frame support unit and the support elements of the attachment unit may be connected to respective joint elements as explained above by methods well known to a person skilled in the art, for example by bolts, welding or any other suitable connecting means. The joint elements are further connected to their respective structures as explained above by methods well known to a person skilled in the art, for example by bolts, welding or any other suitable connecting means.

There is also provided a floating unit comprising at least one mooring frame as explained above for mooring the floating unit to a floating structure or to a non-floating structure. It should be noted that the at least one mooring frame may also be mounted on the floating or non-floating structure, for example a vessel or a quay It should be noted that more than one mooring frame may used, i.e. the floating unit may be provided with two or more mooring frames which work together to absorb forces and energy, particularly in a substantially horizontal plane, which arise from the relative motion between the floating unit and the floating or non-floating structure to which it is moored.

The floating unit preferably comprises at least one first support member comprising a joint element to which the first mooring unit of the at least one mooring frame is attached where the joint element allows the first mooring unit to rotate about at least two independent axes, for example y-direction and z-direction in the Cartesian coordinate system, relative to the at least one first support member.

The floating unit preferably also comprises at least one second support member comprising a joint element to which the second mooring unit of the at least one mooring frame is attached where the joint element allows the second mooring unit to rotate about three independent axes, for example x-direction, y-direction and z-direction in the Cartesian coordinate system, relative to the at least one second support member.

The floating unit may also comprise at least one third support member comprising a joint element to which the frame support unit of the at least one mooring frame is attached where the joint element allows the frame support unit to rotate about three independent axes, for example x-direction, y-direction and z-direction in the Cartesian coordinate system, relative to the at least one third support member.

As mentioned above, the joint elements may be secured to the first support member, the second support member and the third support member respectively by methods well known to a person skilled in the art, for example by bolts, welding or any other suitable connecting means.

The joint elements connecting the first mooring unit to the first support member of the floating unit, the second mooring unit to the second support member of the floating unit and the frame support unit to the third support member of the floating unit preferably comprise a universal joint or a ball joint or any other suitable joint device that is capable of allowing the first mooring unit, the second mooring unit and the frame support unit to rotate about three independent axes, for example x-direction, y-direction and z-direction in the Cartesian coordinate system, relative to the first support member, the second support member and the third support member respectively. A mooring frame as described above may be used to moor a floating unit to a floating structure or a non-floating structure where the mooring frame is mounted on the floating unit. Alternatively, a mooring frame as described above may be used to moor a floating unit to a floating structure or a non-floating structure where the mooring frame is mounted on the floating structure or the non-floating structure.

Torsional freedom of movement of various elements described above, such as the first mooring unit, the second mooring unit and the first and second support members of the attachment unit is required, it is sufficient to provide torsional freedom of movement in one of the joints that these elements are connected to in their respective ends. For example the torsional freedom of movement of the first mooring unit may be provided by either the joint element that the connects the first mooring unit to the floating unit or the joint element connecting the attachment unit to the first mooring unit. It is also possible to provide the torsional freedom of movement within the first mooring unit itself, for example with a separate joint element or by employing a cylinder/piston assembly wherein the piston is rotatable arranged in the cylinder about a longitudinal axis through the cylinder/piston assembly and the first mooring unit.

It should also be noted that a restoring force mentioned herein may be obtained in a way well known in the art by for example a metal spring, a pneumatic gas cylinder/piston assembly or a hydraulic system comprising a control system for providing a desired restoring force.

The invention will now be further explained with reference to a non-limiting embodiment of the invention, and with reference to the attached figures, in which.

The embodiment of the present invention shown in the figures and described in detail below is same in all figures and the same reference numbers have been used for the same features in all figures.

Figure 1:
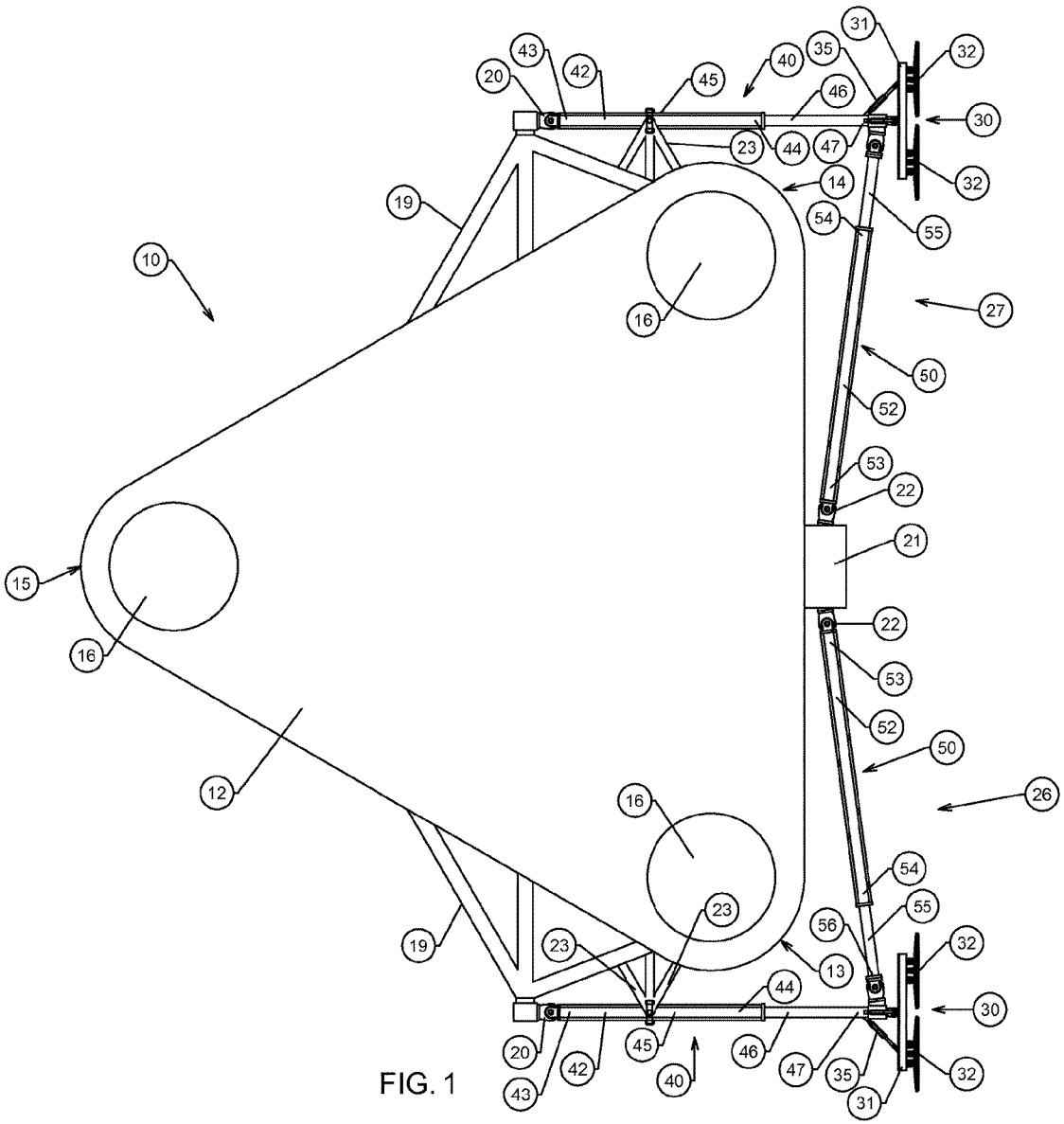
FIG. 1 shows a top view of a floating unit comprising two mooring frames according to the present invention.

Referring to the figures, the embodiment of the present invention shown is a floating unit 10 comprising a deck 12 with a triangular shape having a first corner 13, a second corner 14 and a third corner 15. It should be noted that the deck 12 may be designed with a different shape, for example a square, a rectangular shape or any other desirable shape. The floating unit 10 further comprises three legs 16 attached to the deck of the floating unit at the corners 13, 14, 15. The legs 16 are provided with buoyancy elements or chambers 17 to add buoyancy and stability to the floating unit 10 floating in a body of water with a surface S as indicated in the figures.

In order to moor the floating unit 10 to another floating structure, such as a LNG-tanker or another type of vessel, or to a non-floating structure, such as a quay, the floating structure 10 is provided with at least one mooring frame. The embodiment of the floating unit 10 shown in the figures is provided with two mooring frames, a first mooring frame 26 and a second mooring frame 27. Apart from being laterally inverted, the design of the first mooring frame 26 and the second mooring frame 27 are substantially identical. The floating unit 10 may also be provided with more than two mooring frames 26, 27 if that is considered necessary, for example a larger floating unit or vessel may require more than two mooring frames to be safely moored. It should also be noted that it would be possible to arrange one or more mooring frames 26, 27 on the floating or non-floating structure, for example to a quay such that mooring units 26, 27 may be used to moor different vessels at the quay.

A mooring frame 26, 27 according to the invention will now be described with reference to the first and second mooring frames 26, 27 shown in the figures. It should be kept in mind that the two mooring frames 26, 27 are provided with the same features and the description of the two mooring frames 26, 27 will therefore be similar.

The first mooring frame 26 comprises a first mooring unit 40 for transferring forces and/or absorbing energy substantially in a first direction and a second mooring unit 50 for transferring forces and/or absorbing energy substantially in a second direction when the floating unit 10 is moored to a floating or non-floating structure. The forces and/or the energy mentioned arises from relative motion between the floating unit and the floating or non-floating structure that floating unit is moored to due to external excitation forces, such as for example wind, waves or currents in the water. The first direction and second directions above are typically the x-direction and y-direction respectively in a Cartesian coordinate system where the x-direction and the y-direction form a substantially horizontal plane.

The first mooring unit 40 may comprise a cylinder 42 with a first end portion 43 and a second end portion 44. The first end portion 43 of the cylinder 42 is attached to a joint element 20. The joint element 20 is further attached to a first support member 19 which is mounted on the floating unit 10, for example to the deck 12 as shown in the figures. The joint element 20 is designed so that the first mooring unit 40 can rotate about two or three independent axes, i.e. none of the two or three axes are parallel to each other, relative to the first support member 19. The joint element 20 shown in the figures comprises a universal joint, but the joint element 20 may also comprise a ball joint or any other type of joint that allows the first mooring unit 40 to rotate about two or three independent axes relative to the first support member 19.

Figure 3:
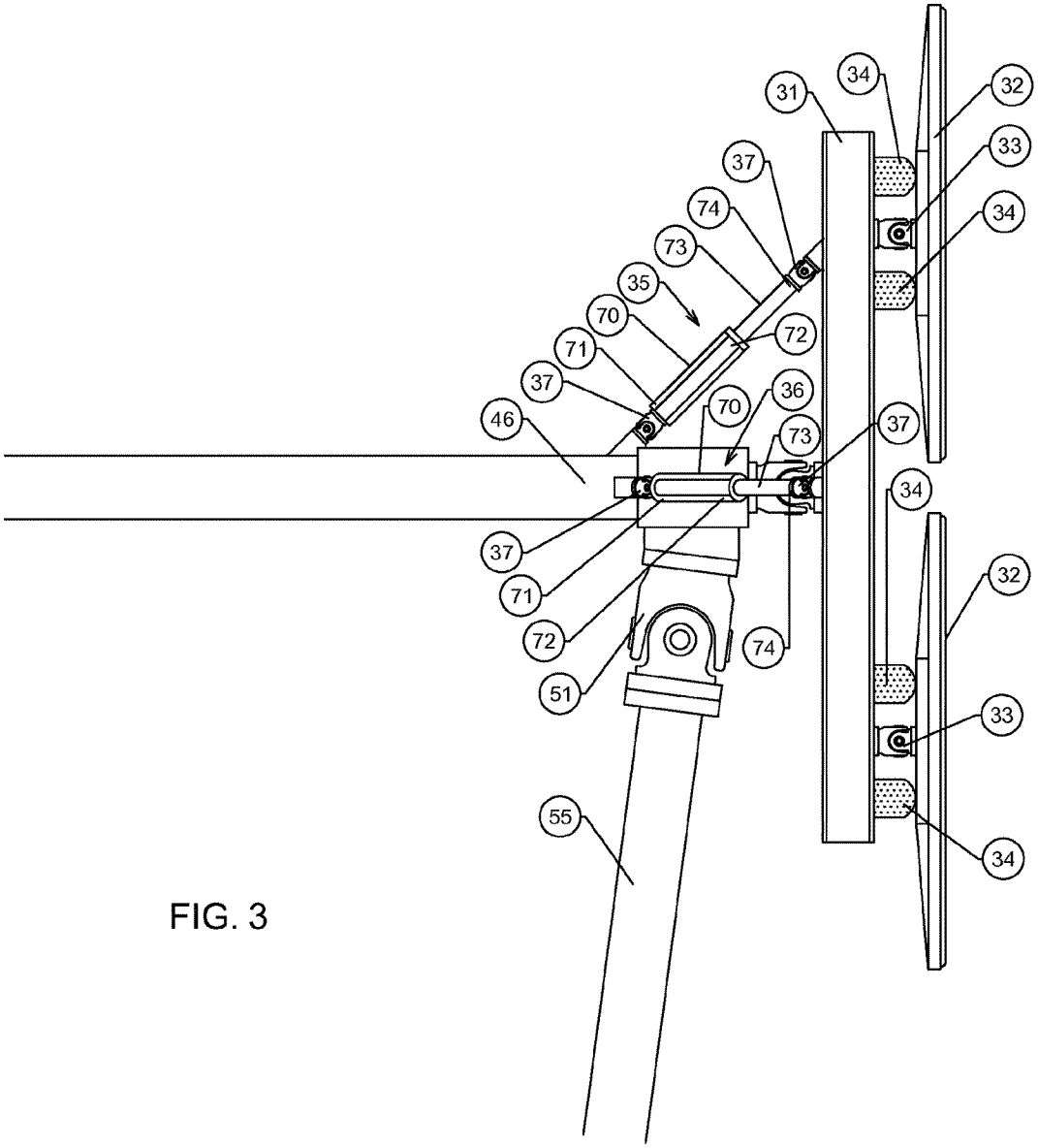
FIG. 3 shows a top view of an enlarged view of an attachment unit shown in FIGS. 1-2.
Figure 4:
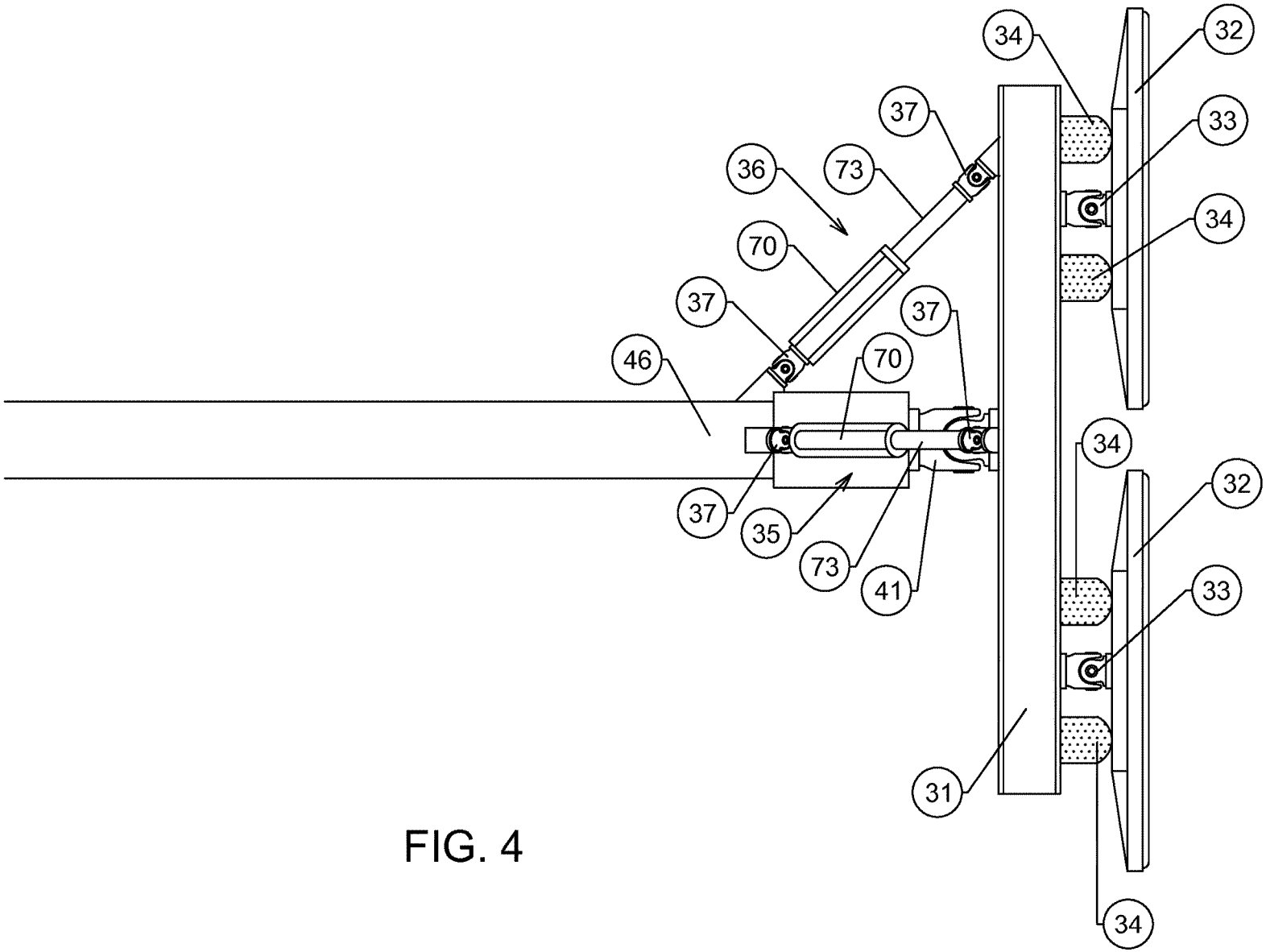
FIG. 4 shows a side view of an enlarged view of the attachment unit shown in FIG. 3.

The first mooring unit 40 may further comprise a piston 46 which is arranged in the cylinder 42 movably in and out of the cylinder 42 in a longitudinal direction of the first mooring unit 40. An end portion 47 of the piston is attached to an attachment unit 30 with a joint element 41 (see FIGS. 3 and 4) which allows the attachment unit 30 to rotate about three independent axes relative to the first mooring unit 40. On the figures it is shown that the attachment unit 30 is attached to the first mooring unit 40, but the attachment unit 30 may instead be attached with the joint element 41 to the second mooring unit 50 of the first mooring frame 26.

The piston 46 extends into the cylinder 42 and is movably arranged in the cylinder such that it moves in and out of the cylinder 42 as the floating unit 10 moves relative to the floating or non-floating structure to which the floating unit 10 is attached.

The first mooring unit 40 preferably comprises a spring device and preferably also a damper device, for example a hydraulic damper device, which may be arranged in the cylinder in a way that is well known in the art and therefore not described in detail here. The assembly comprising the cylinder 42 and the piston 46 is preferably double-acting, i.e. the damper device damps movements that pull the piston 46 out of the cylinder 42 as well as movements that push the piston 46 into the cylinder 42. However, the cylinder/piston assembly of the first mooring unit 40 may also be single-acting, i.e. only movements in one direction are damped, for example movements that push the piston 46 into the cylinder 42. The second mooring unit 50 may comprise a cylinder 52 with a first end portion 53 and a second end portion 54. The first end portion 53 of the cylinder 52 is attached to a joint element 22. The joint element 22 is further attached to a second support member 21 which is mounted on the floating unit 10, for example to the deck 12 as indicated in the figures. The joint element 22 is designed so that the second mooring unit 50 can rotate about two or three independent axes, i.e. none of the two or three axes are parallel to each other, relative to the second support member 21. The joint element 22 shown in the figures comprises a universal joint, but the joint element 22 may also comprise a ball joint or any other type of joint that allows the second mooring unit 50 to rotate about two or three independent axes relative to the second support member 21.

Figure 2:
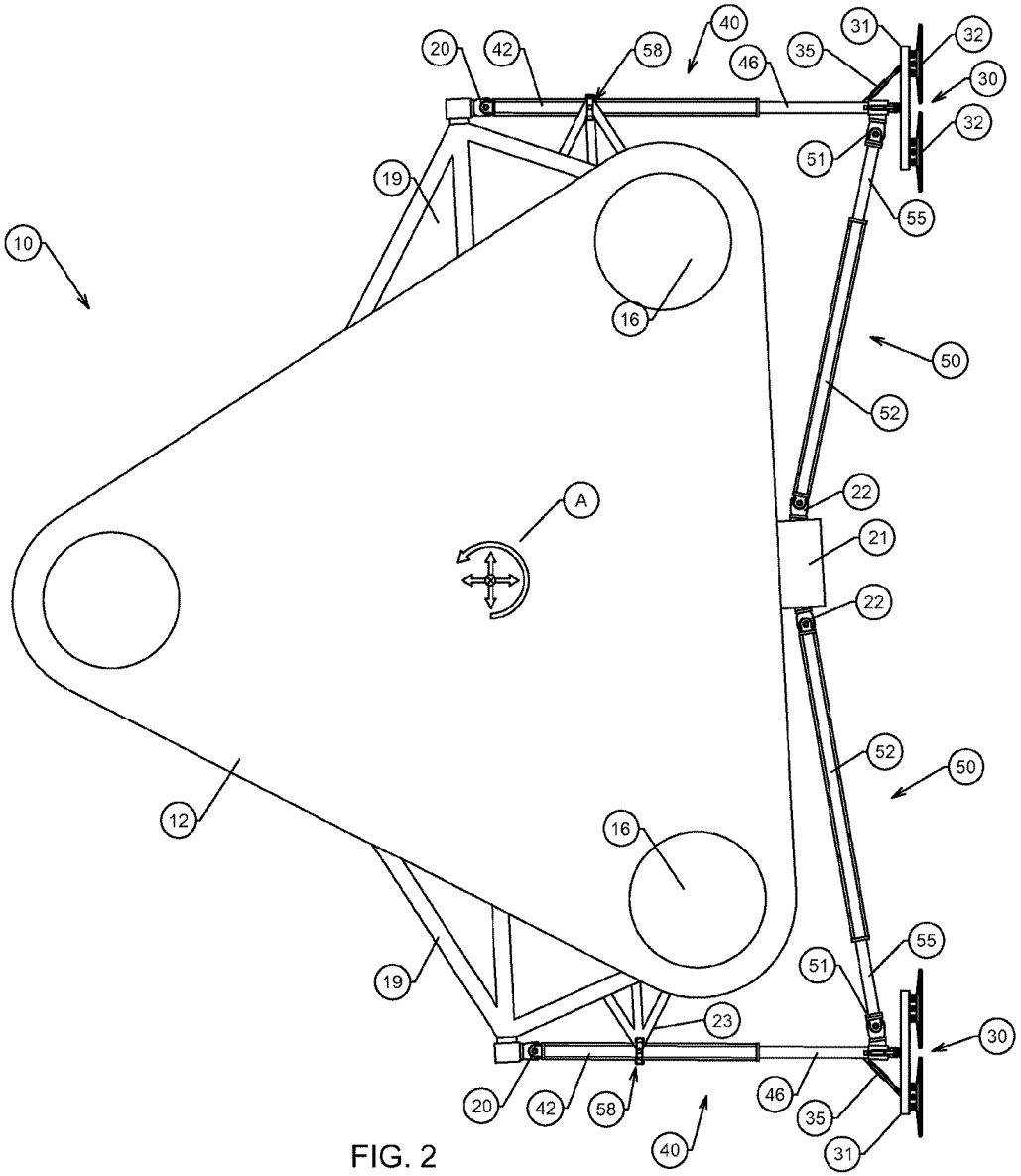
FIG. 2 shows a top view of the floating unit shown in FIG. 1, but with a slightly displaced position compared to the position shown in FIG. 1 due to relative motion between the floating unit and the structure to which it is moored.

The second mooring unit 50 may further comprise a piston 55 which is arranged in the cylinder 52 movably in and out of the cylinder 52 in a longitudinal direction of the second mooring unit 50. An end portion 56 of the piston is attached to the first mooring unit 40 with a joint element 51 (see FIG. 2) which allows the second mooring unit 50 to rotate about two or three independent axes relative to the first mooring unit 40. In the figures it is shown that the second mooring unit 50 is attached to the first mooring unit 40, but the opposite may also be the case, i.e. the first mooring unit 40 may be attached with the joint element 51 to the second mooring unit 50.

The piston 55 extends into the cylinder 52 and is movably arranged in the cylinder such that it moves in and out of the cylinder 52 as the floating unit 10 moves relative to the floating or non-floating structure to which the floating unit 10 is attached.

The second mooring unit 50 preferably comprises a spring device and preferably also a damper device, for example a hydraulic damper device, which may be arranged in the cylinder in a way that is well known in the art and therefore not described in detail here. The assembly comprising the cylinder 52 and the piston 55 is preferably double-acting, i.e. the damper device damps movements that pull the piston 55 out of the cylinder 52 as well as movements that push the piston 55 into the cylinder 52. However, the cylinder/piston assembly of the second mooring unit 50 may also be single-acting, i.e. only movements in one direction are damped, for example movements that push the piston 55 into the cylinder 52.

Figure 5:
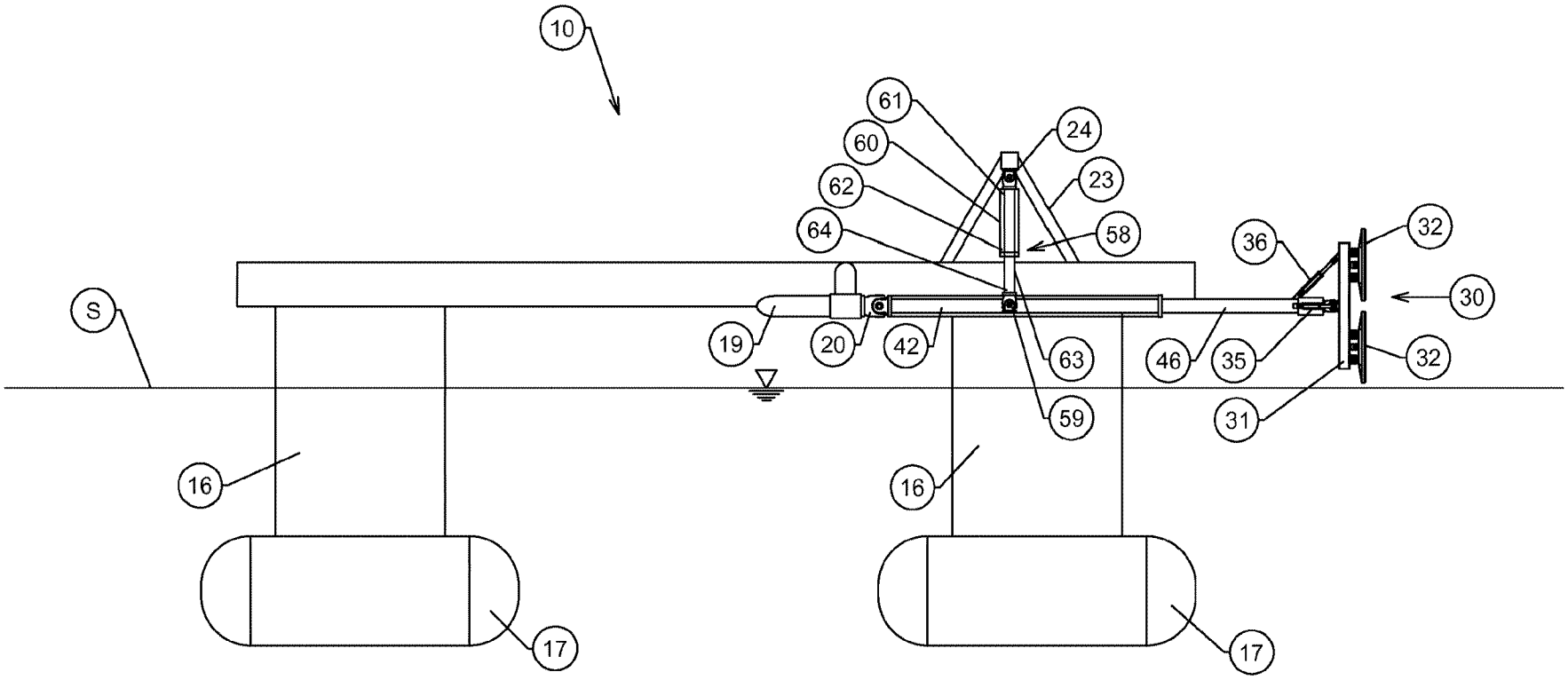
FIG. 5 shows a side view of the floating unit shown in FIGS. 1-4.
Figure 6:
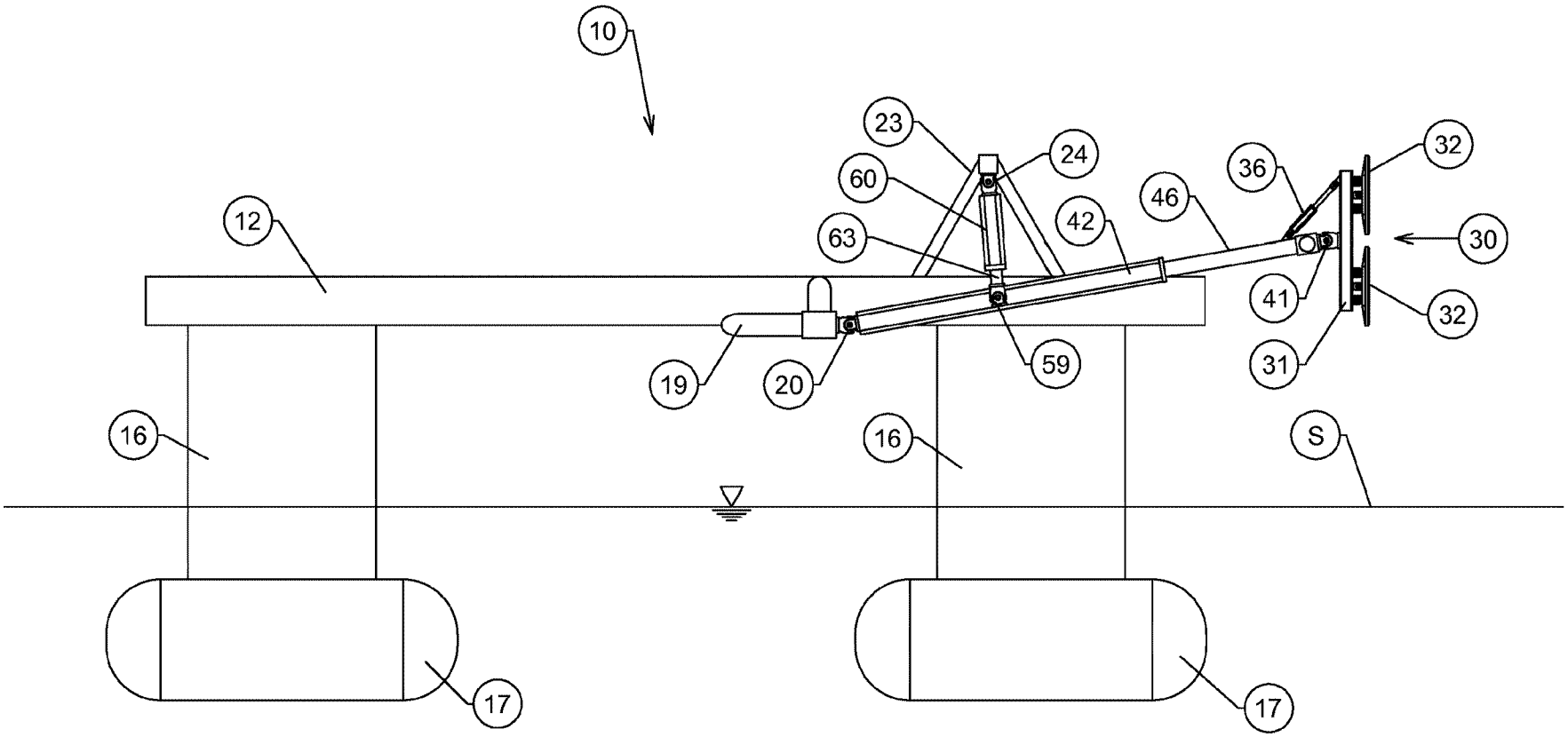
FIG. 6 shows a side view of the floating unit shown in FIG. 5, but with a slightly displaced position downward compared to the position shown in FIG. 5 due to relative motion between the floating unit and the structure to which it is moored.
Figure 7:
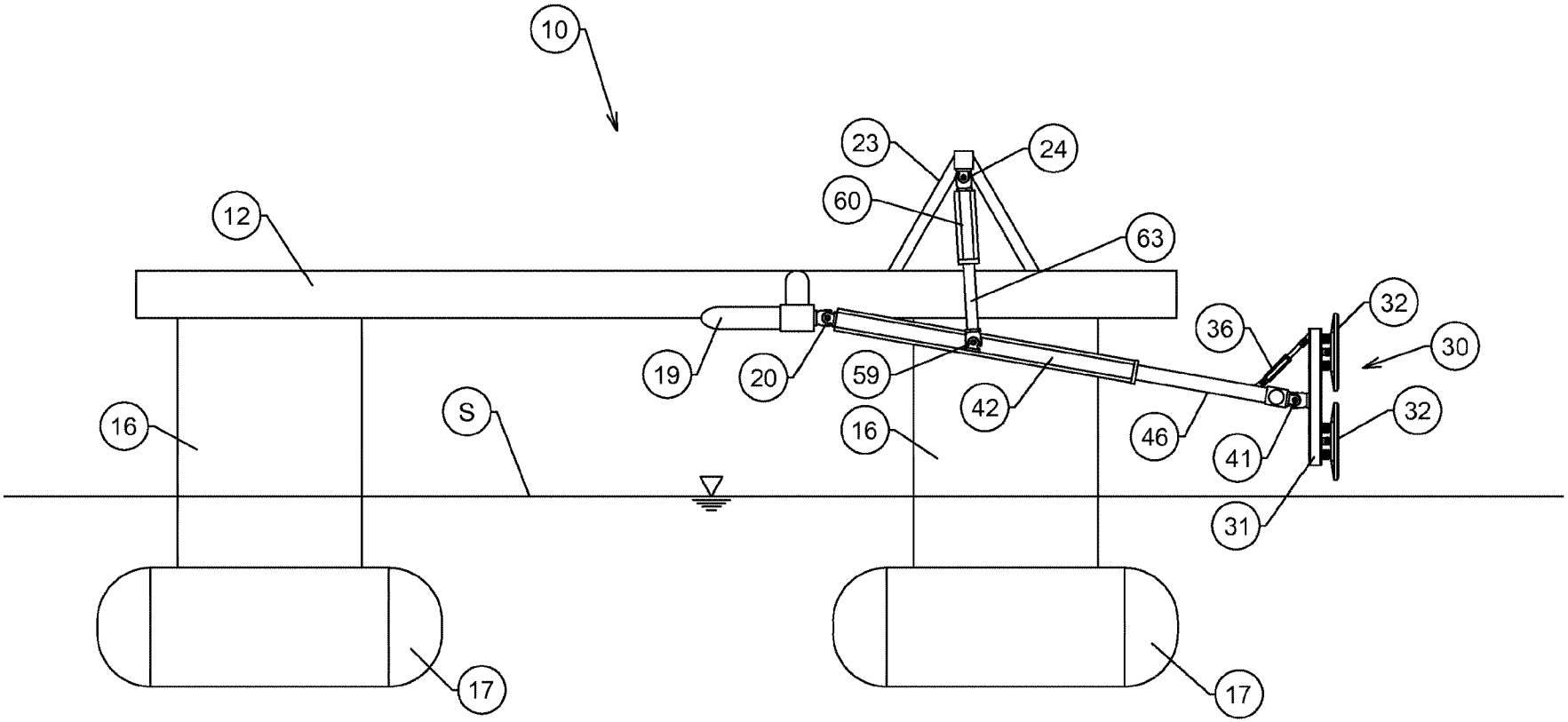
FIG. 7 shows a side view of the floating unit shown in FIGS. 5 and 6, but with a slightly displaced position upward compared to the position shown in FIG. 5 due to relative motion between the floating unit and the structure to which it is moored.

Referring to FIGS. 5-7, the first mooring frame 26 is further provided with a frame support unit 58 which may comprise a cylinder/piston assembly with a cylinder 60 and a piston 63 which is arranged in the cylinder 60 movable in and out of the cylinder. The cylinder 60 comprises a first end portion 61 and a second end portion 62. The first end portion 61 of the cylinder 60 is attached to a joint element 24. The joint element 24 is further attached to a frame support member 23 which is mounted on the floating unit 10, for example to the deck 12 as shown in the figures. The joint element 24 is designed so that the cylinder 60 of the frame support unit 58 can rotate about two or three independent axes, i.e. none of the two or three axes are parallel to each other, relative to the third support member 23. The joint element 24 shown in the figures comprises a universal joint, but the joint element 24 may also comprise a ball joint or any other type of joint that allows the frame support unit 58 to rotate about three independent axes relative to the third support member 23.

The piston 63 extends into the cylinder 60 and is movably arranged in the cylinder such that it moves in and out of the cylinder 60 as the floating unit 10 moves relative to the floating or non-floating structure to which the floating unit 10 is attached.

The frame support unit 58 preferably comprises a spring device and preferably also a damper device, for example a hydraulic damper device, which may be arranged in the cylinder in a way that is well known in the art and therefore not described in detail here. The spring device is arranged to provide support for the first and second mooring units 40, 50 and to help keep the first and second mooring units 40, 50 in a desired position vertically. The frame support unit 58 may also be arranged to damp vertical movements of the first mooring frame 26. The assembly comprising the cylinder 60 and the piston 63 may be double-acting, i.e. the damper device damps movements that pull the piston 63 out of the cylinder 60 as well as movements that push the piston 63 into the cylinder 60. However, the cylinder/piston assembly of the frame support unit 58 may also be single-acting, i.e. only movements in one direction are damped, for example movements that push the piston 63 into the cylinder 60. The second mooring frame 27 is essentially identical to the first mooring frame 26 and comprises a first mooring unit 40 for transferring forces and/or absorbing energy substantially in a first direction and a second mooring unit 50 for transferring forces and/or absorbing energy substantially in a second direction when the floating unit 10 is moored to a floating or non-floating structure. The forces and/or the energy mentioned arises from relative motion between the floating unit and the floating or non-floating structure that floating unit is moored to external excitation forces, such as for example wind, waves or currents in the water. The first direction and second direction above are typically the x-direction and y-direction respectively in a Cartesian coordinate system where the x-direction and the y-direction form a substantially horizontal plane.

The first mooring unit 40 may comprise a cylinder 42 with a first end portion 43 and a second end portion 44. The first end portion 43 of the cylinder 42 is attached to a joint element 20. The joint element 20 is further attached to a first support member 19 which is mounted on the floating unit 10, for example to the deck 12 as shown in the figures. The joint element 20 is designed so that the first mooring unit 40 can rotate about two or three independent axes, i.e. none of the two or three axes are parallel to each other, relative to the first support member 19. The joint element 20 shown in the figures comprises a universal joint, but the joint element 20 may also comprise a ball joint or any other type of joint that allows the first mooring unit 40 to rotate about two or three independent axes relative to the first support member 19.

The first mooring unit 40 may further comprise a piston 46 which is arranged in the cylinder 42 movably in and out of the cylinder 42 in a longitudinal direction of the first mooring unit 40. An end portion 47 of the piston is attached to an attachment unit 30 with a joint element 41 (see FIGS. 3 and 4) which allows the attachment unit 30 to rotate about three independent axes relative to the first mooring unit (40). On the figures it is shown that the attachment unit 30 is attached to the first mooring unit 40, but the attachment unit 30 may instead be attached with the joint element 41 to the second mooring unit 50 of the second mooring frame 27.

The piston 46 extends into the cylinder 42 and is movably arranged in the cylinder such that it moves in and out of the cylinder 42 as the floating unit 10 moves relative to the floating or non-floating structure to which the floating unit 10 is attached.

The first mooring unit 40 preferably comprises a spring device and preferably also a damper device, for example a hydraulic damper device, which may be arranged in the cylinder in a way that is well known in the art and therefore not described in detail here. The assembly comprising the cylinder 42 and the piston 46 is preferably double-acting, i.e. the damper device damps movements that pull the piston 46 out of the cylinder 42 as well as movements that push the piston 46 into the cylinder 42. However, the cylinder/piston assembly of the first mooring unit 40 may also be single-acting, i.e. only movements in one direction are damped, for example movements that push the piston 46 into the cylinder 42.

The second mooring unit 50 of the second mooring frame 27 may comprise a cylinder 52 with a first end portion 53 and a second end portion 54. The first end portion 53 of the cylinder 52 is attached to a joint element 22. The joint element 22 is further attached to a second support member 21 which is mounted on the floating unit 10, for example to the deck 12 as indicated in the figures. The second support member 21 may be the same support member as the second mooring unit 50 of the first mooring frame 26 is mounted to with its joint element 22 as shown in the figures, or the second mooring units 50 of the first and second mooring frames 26, 27 may be attached to separate second support members 21. The joint element 22 is designed so that the second mooring unit 50 can rotate about two or three independent axes, i.e. none of the two or three axes are parallel to each other, relative to the second support member 21. The joint element 22 shown in the figures comprises a universal joint, but the joint element 22 may also comprise a ball joint or any other type of joint that allows the second mooring unit 50 to rotate about two or three independent axes relative to the second support member 21.

The second mooring unit 50 may further comprise a piston 55 which is arranged in the cylinder 52 movably in and out of the cylinder 52 in a longitudinal direction of the second mooring unit 50. An end portion 56 of the piston is attached to the first mooring unit 40 with a joint element 51 (see FIG. 2) which allows the second mooring unit 50 to rotate about two or three independent axes relative to the first mooring unit 40. In the figures it is shown that the second mooring unit 50 is attached to the first mooring unit 40, but the opposite may also be the case, i.e. the first mooring unit 40 may be attached with the joint element 51 to the second mooring unit 50.

The piston 55 extends into the cylinder 52 and is movably arranged in the cylinder such that it moves in and out of the cylinder 52 as the floating unit 10 moves relative to the floating or non-floating structure to which the floating unit 10 is attached.

The second mooring unit 50 preferably comprises a spring device and preferably also a damper device, for example a hydraulic damper device, which may be arranged in the cylinder in a way that is well known in the art and therefore not described in detail here. The assembly comprising the cylinder 52 and the piston 55 is preferably double-acting, i.e. the damper device damps movements that pull the piston 55 out of the cylinder 52 as well as movements that push the piston 55 into the cylinder 52. However, the cylinder/piston assembly of the second mooring unit 50 may also be single-acting, i.e. only movements in one direction are damped, for example movements that push the piston 55 into the cylinder 52.

Referring to FIGS. 5-7, the second mooring frame 27 is further provided with a frame support unit 58 which may comprise a cylinder/piston assembly with a cylinder 60 and a piston 63 which is arranged in the cylinder 60 movable in and out of the cylinder. The cylinder 60 comprises a first end portion 61 and a second end portion 62. The first end portion 61 of the cylinder 60 is attached to a joint element 24. The joint element 24 is further attached to a frame support member 23 which is mounted on the floating unit 10, for example to the deck 12 as shown in the figures. The joint element 24 is designed so that the cylinder 60 of the frame support unit 58 can rotate about two or three independent axes, i.e. none of the two or three axes are parallel to each other, relative to the third support member 23. The joint element 24 shown in the figures comprises a universal joint, but the joint element 24 may also comprise a ball joint or any other type of joint that allows the frame support unit 58 to rotate about two or three independent axes relative to the third support member 23.

The piston 63 extends into the cylinder 60 and is movably arranged in the cylinder such that it moves in and out of the cylinder 60 as the floating unit 10 moves relative to the floating or non-floating structure to which the floating unit 10 is attached.

The frame support unit 58 preferably comprises a spring device and preferably also a damper device, for example a hydraulic damper device, which may be arranged in the cylinder in a way that is well known in the art and therefore not described in detail here. The spring device is arranged to provide support for the first and second mooring units 40, 50 and to help keep the first and second mooring units 40, 50 in a desired position vertically. The frame support unit 58 may also be arranged to damp vertical movements of the second mooring frame 27. The assembly comprising the cylinder 60 and the piston 63 may be double-acting, i.e. the damper device damps movements that pull the piston 63 out of the cylinder 60 as well as movements that push the piston 63 into the cylinder 60. However, the cylinder/piston assembly of the frame support unit 58 may also be single-acting, i.e. only movements in one direction are damped, for example movements that push the piston 63 into the cylinder 60.

Figure 8:
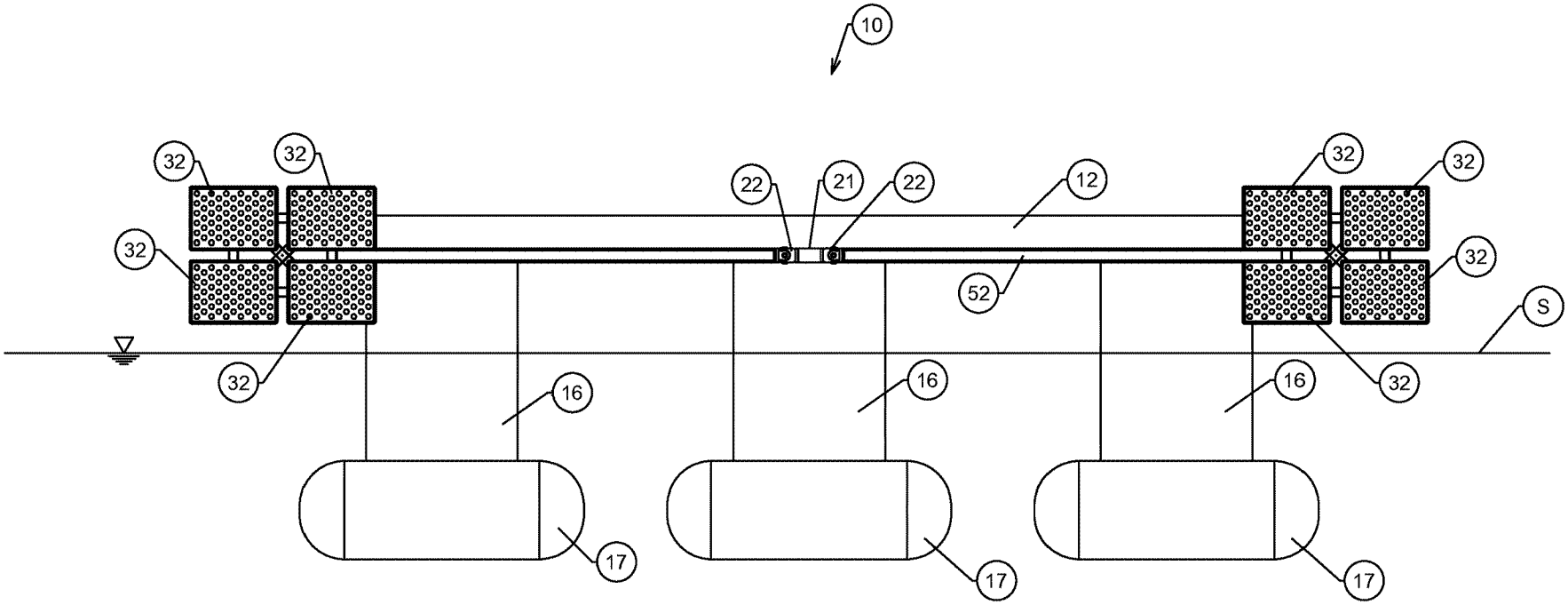
FIG. 8 shows a front view of the floating unit shown in FIGS. 1-4.
Figure 9:
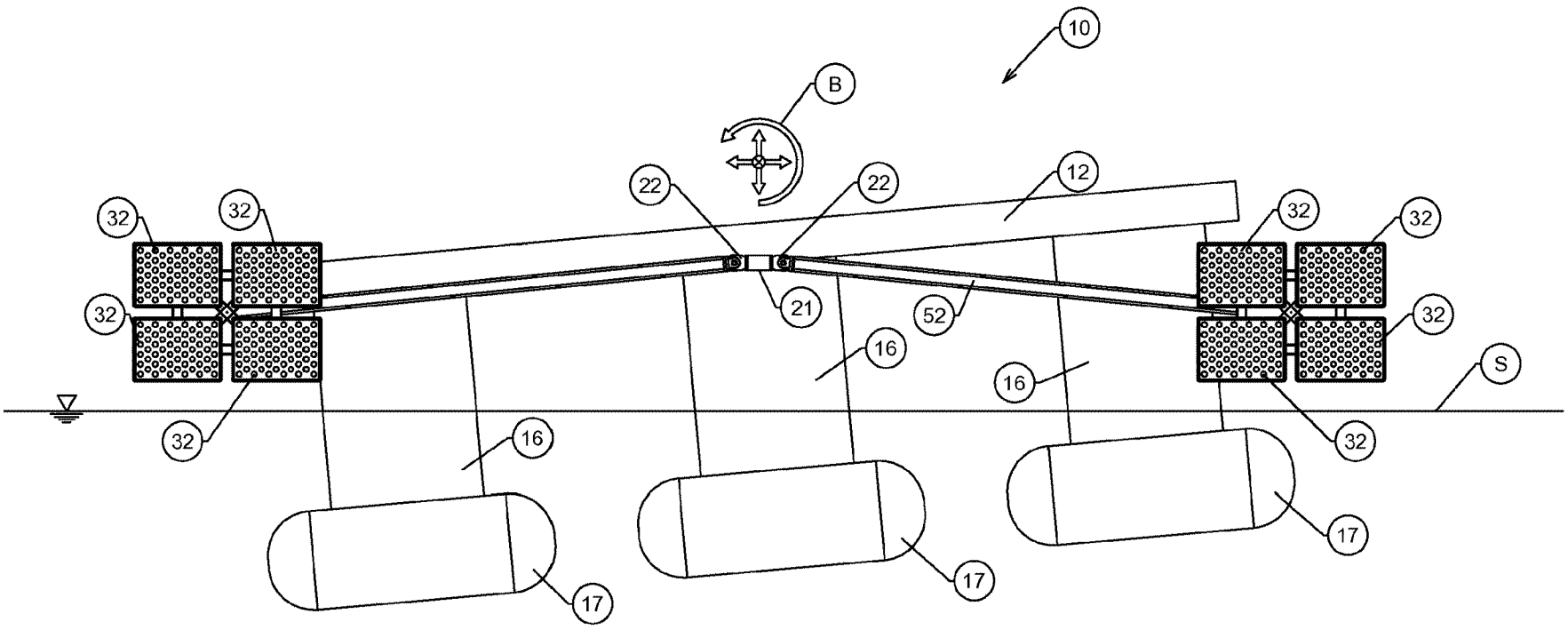
FIG. 9 shows the same front view of the floating unit as FIG. 3, but with a slightly displaced position compared to the position shown in FIG. 5 due to relative motion between the floating unit and the structure to which it is moored.
Figure 10:
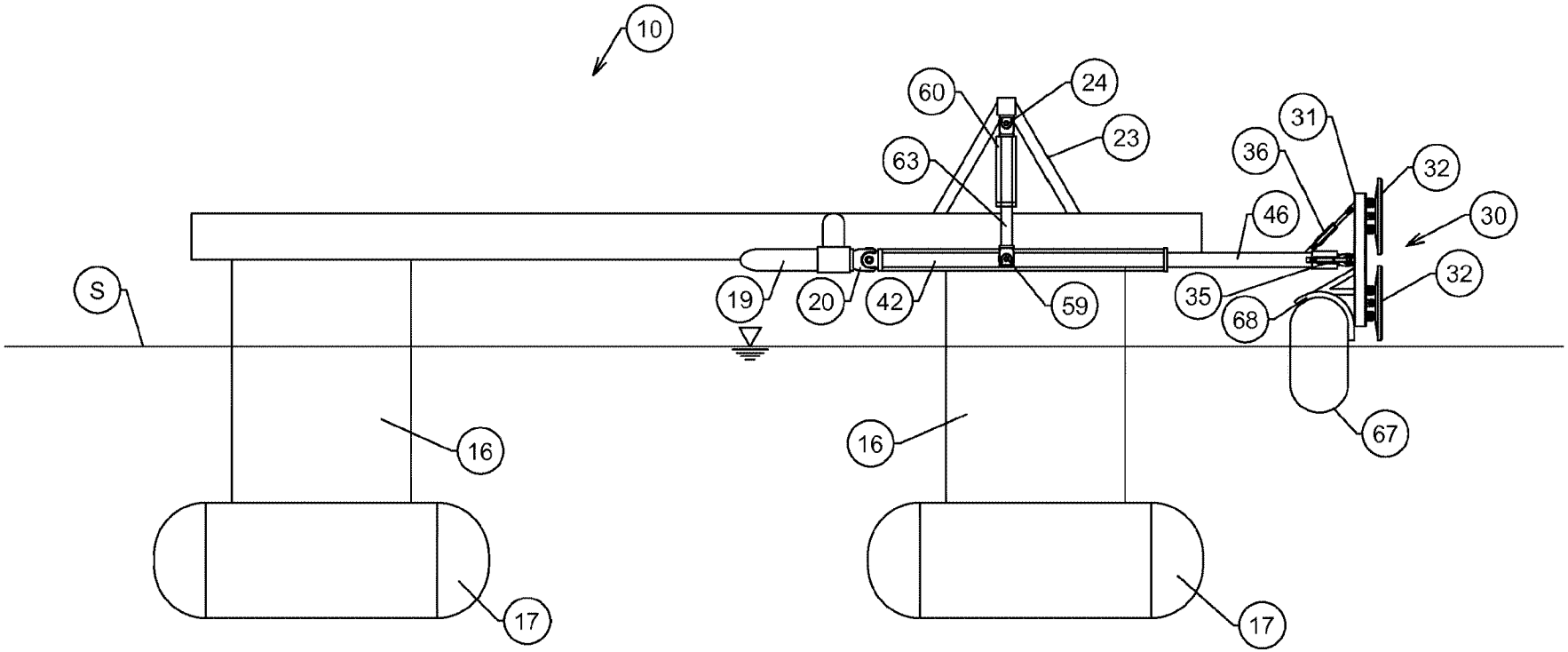
FIG. 10 shows a floating unit as shown in FIGS. 1-6 with a buoyancy element mounted on the attachment unit of the mooring frames.
Figure 11:
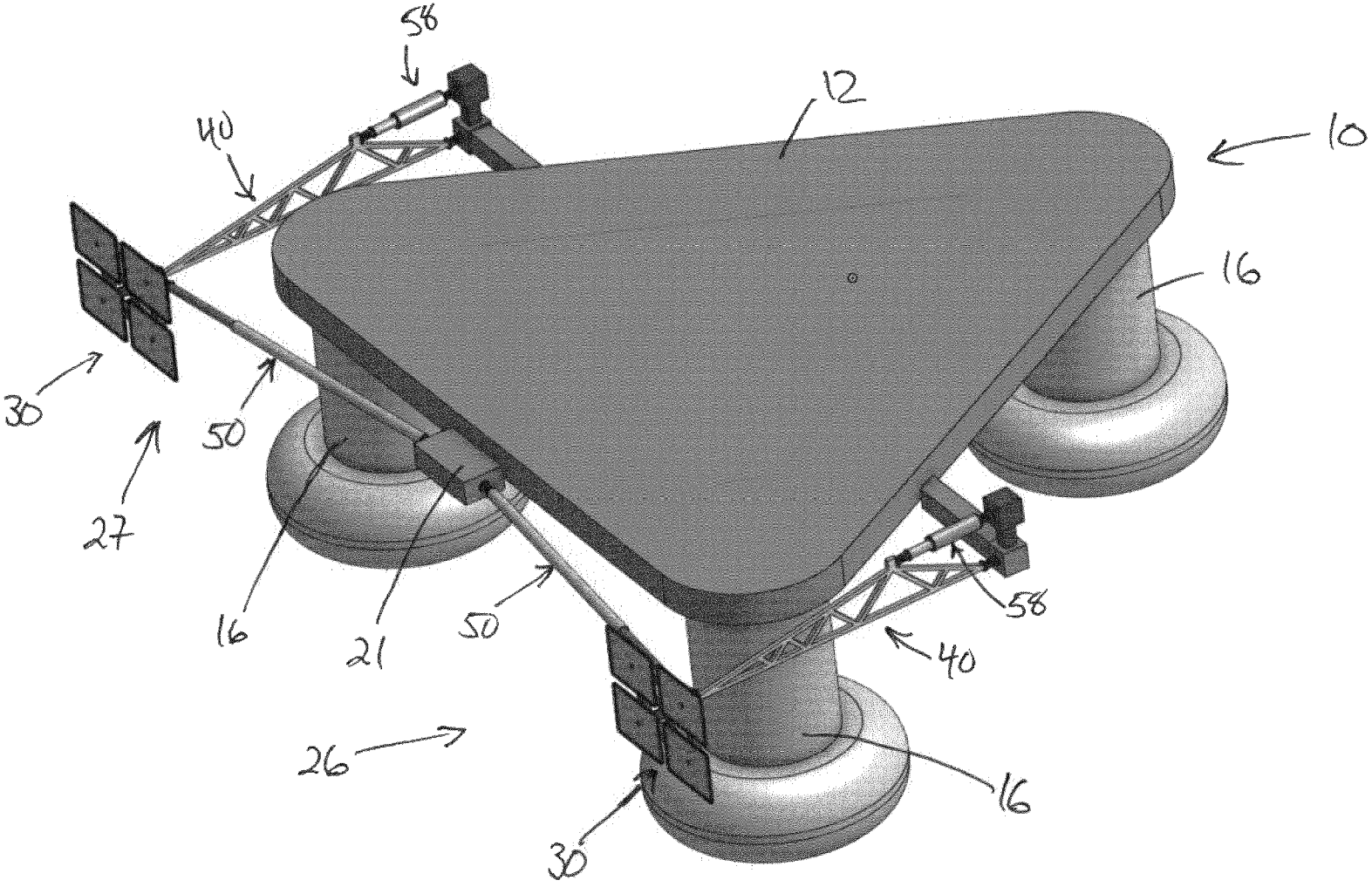
FIG. 11 shows a floating unit with an alternative design of the first mooring unit.
Figure 12:
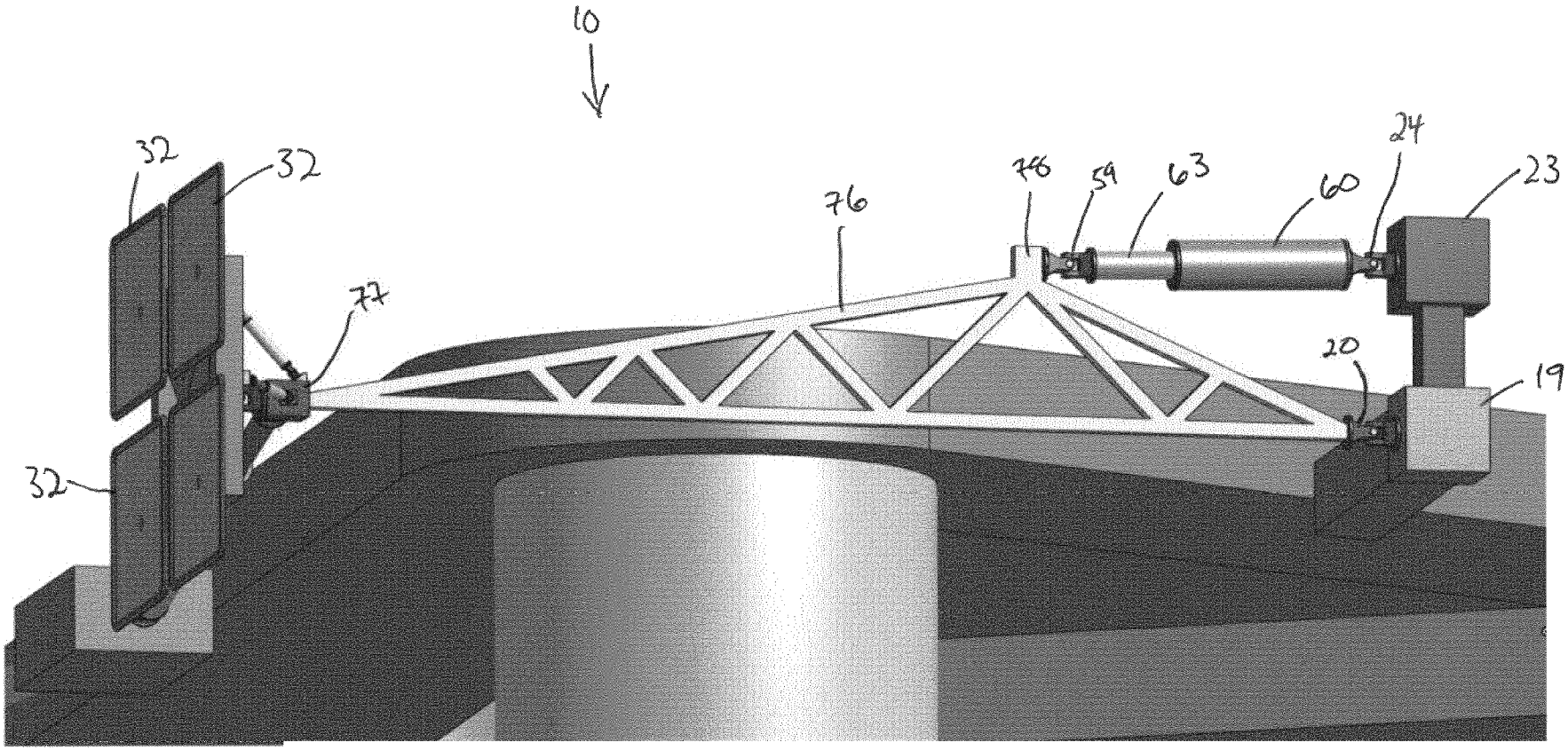
FIG. 12 shows the first mooring unit of the floating unit shown in FIG. 11.
Figure 13:
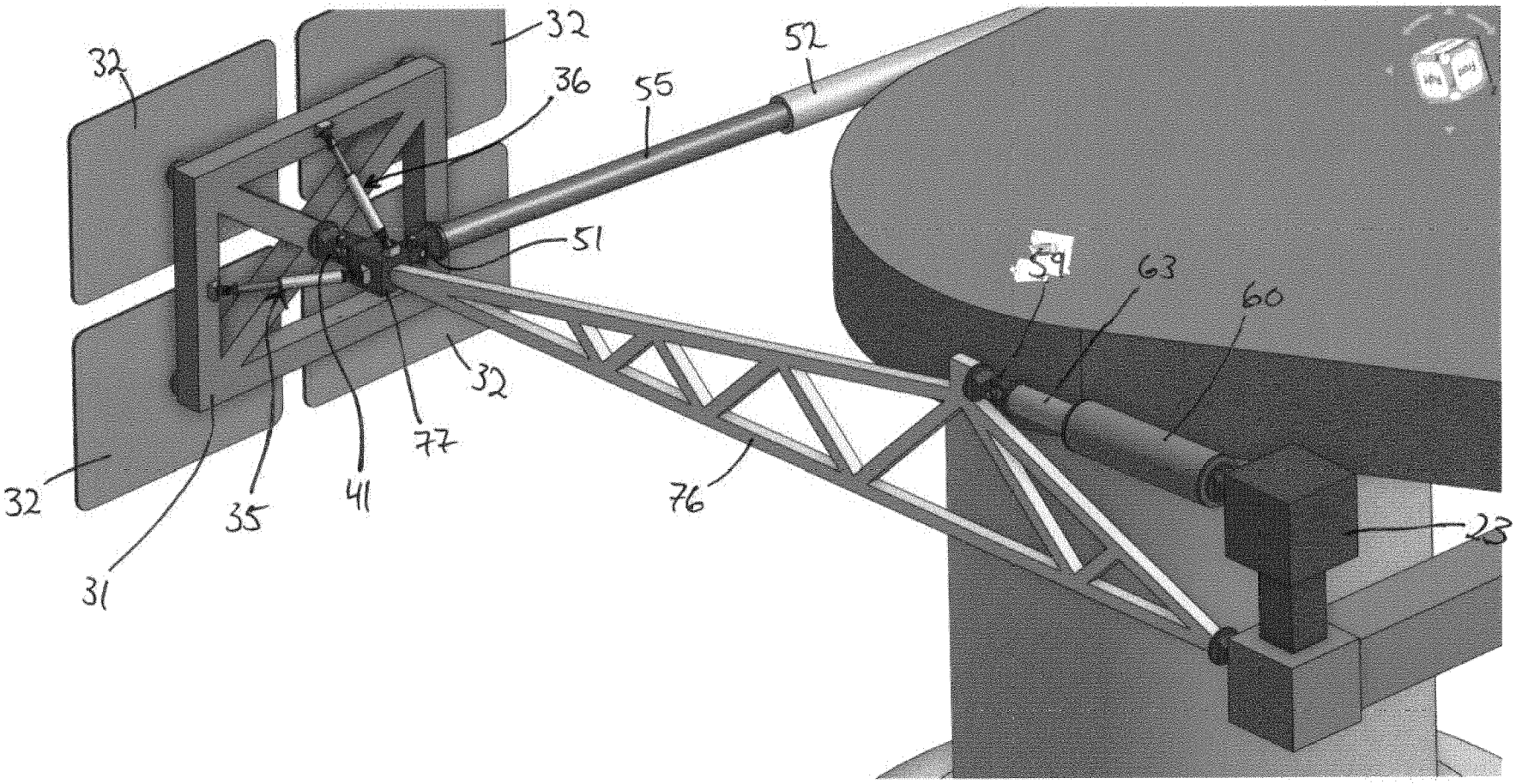
FIG. 13 shows the first mooring unit and a part of the second mooring unit of the floating unit shown in FIGS. 11-12.
Figure 14:
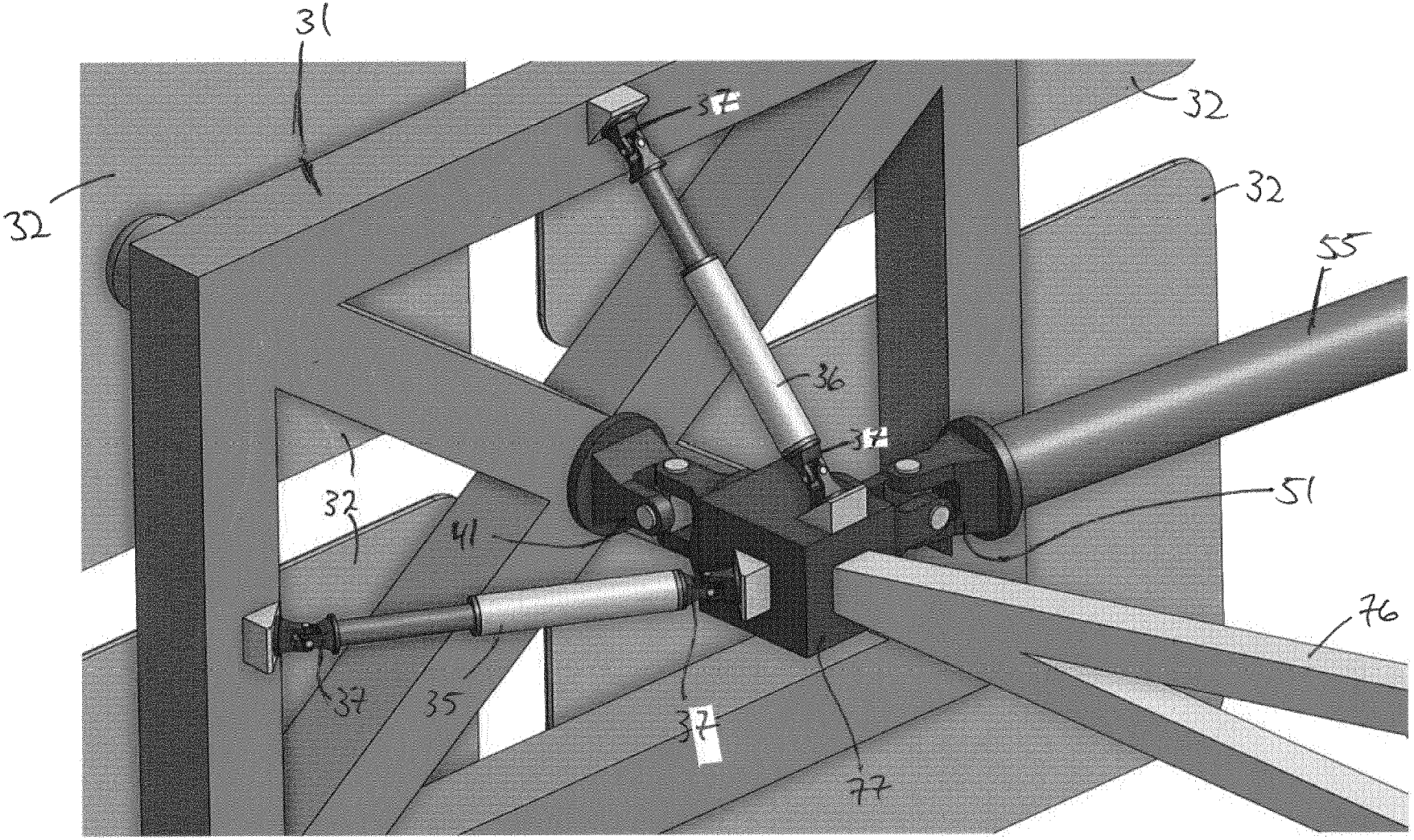
FIG. 14 shows a detailed view of the support frame of the attachment unit and parts of the first mooring unit and the second mooring unit of the floating unit shown in FIGS. 11-13.

In FIG. 10 there is indicated that the first mooring frame 26 and/or the second mooring frame 27 may, in addition to, or instead of, the frame support units 58, be provided with a buoyancy element 67 for further support of the first mooring frame 26 and/or the second mooring frame 27. In the figure, the buoyancy element is shown attached to a support frame 68 which is mounted to the attachment unit 30, but the buoyancy element 67 may of course be attached to the first or second mooring units 40, 50 of the first and second mooring frames 26, 27, An attachment unit 30 is attached to both the first mooring frame 26 and the second mooring frame 27. An attachment unit 30 is shown in more detail in FIGS. 3 and 4, and comprises a support frame 31 to which at least one, but preferably a plurality, for example four as clearly shown in FIGS. 8 and 9, of attachment elements 32 are attached with respective joint elements 33. The attachment elements 32 may be vacuum pads or electromagnetic pads that are capable of attaching themselves to the surface of a floating or non-floating structure such as a ship or a quay. The joint element 33 is designed so that the attachment element 32 can rotate about three independent axes, i.e. none of the three axes are parallel to each other, relative to the support frame 31. The joint element 33 shown in the figures comprises a universal joint, but the joint element 33 may also comprise a ball joint or a fender element, or any other type of joint that allows the attachment element 32 to rotate about two or three independent axes relative to the support frame 31.

The attachment unit 30 also comprises a fender 34 which limits the rotational movement of the support frame 31. The fender 34 may be ring-shaped or comprise individual elements between the attachment element 32 and the support frame 31, and may be made of any suitable material such as steel possibly covered with a rubber material.

The support frame 31 of the attachment unit 30 can be attached with a joint element 41 to the first mooring unit 40 of the first and second mooring frames 26, 27 as shown in the figures, but may alternatively be attached to the second mooring unit 50 of the first and second mooring frames 26, 27 as mentioned above. Again, the joint element 41 is designed so that the attachment unit 30 can rotate about three independent axes, i.e. none of the three axes are parallel to each other, relative to the first mooring unit 40, as shown in the figures, or relative to the second mooring unit 50 if the attachment unit 30 is attached to the second mooring unit 50. The joint element 37 shown in the figures comprises a universal joint, but the joint element 37 may also comprise a ball joint or any other type of joint that allows the attachment unit 30 to rotate about three independent axes relative to the first or second mooring unit 40, 50.

In addition, there is provided at least one, but preferably more than one, support elements for keeping the attachment unit 30 in a desired position with regard to movements about three independent axes, such as clearly shown in the figures, prior to and after attachment to an external surface of a floating or non-floating structure is engaged. As shown in the figures, a first support element 35 and a second support element 36 may be provided, where the first and second support elements 35, 36 are attached with respective joint elements 37 to the support frame 31 in one end and with respective joint elements 37 to the first mooring unit 40, as shown in the figures, or alternatively to the second mooring unit 50, in the other end. At least one of the two joint elements 37 that each of the first and second support elements 35, 36 are attached to, i.e. altogether four joint elements 37, are designed so that the first and second support elements 35, 36 can rotate about three independent axes, i.e. none of the three axes are parallel to each other, relative to respectively the support frame 31 and to the first mooring unit 40, as shown in the figures, or the second mooring unit 50 if the attachment unit 30 is attached to the second mooring unit 50. The joint elements 37 shown in the figures comprise a universal joint, but the joint elements 37 may also comprise a ball joint or any other type of joint that allows the first and second support elements 35, 36 to rotate about two or three independent axes relative to the support frame 31 and the first or second mooring unit 40, 50.

The first and second support elements 35, 36 is preferably of the same type as described above comprising a piston 73 which is arranged in the cylinder 70 where the piston is arranged movably in and out of the cylinder 70 in a longitudinal direction of the first and second support elements 35, 36 respectively. The piston 73 extends into the cylinder 70 and is movably arranged in the cylinder such that it moves in and out of the cylinder as the floating unit 10 moves relative to the floating or non-floating structure to which the floating unit 10 is attached.

The first and second support elements 35, 36 preferably comprise a spring device and preferably also a damper device, for example a hydraulic or pneumatic damper device, which may be arranged in the cylinder 70 in a way that is well known in the art and therefore not described in detail here. The assembly comprising the cylinder 70 and the piston 73 is preferably double-acting, i.e. the device provides a damping and restoring force that acts in the opposite direction of any movement pulling the piston 73 out of the cylinder 70 as well as any movements pushing the piston 73 into the cylinder 70. However, the cylinder/piston assembly of the first and second support elements 35, 36 may also be single-acting, i.e. damping and restoring forces only acts in one direction, for example movements that push the pistons 73 into respective cylinders 70.

In addition to the first and second support elements 35, 36, a third spring or damper unit may be provided to provide stiffness and preferably damping to the one of the support frame 31 relative to the first mooring unit 40 or the second mooring unit 50 to which it is attached, in a third rotational and independent degree of freedom, i.e. a degree of freedom that is not parallel to the rotational degrees of freedom restrained by the damper units 35, 36. Hence the support frame 31 is kept in a fixed position while the attachment elements 32 are not engaged, i.e. when no external forces are applied to the support frame, but is also free to rotate about three independent axes relative to the one of the first mooring unit 40 and the second mooring unit 50 that it is attached to when the attachment elements are engaged, i.e. when external forces are applied to the support frame 31. The third spring or damper unit is not shown on the figures, but may consist of a third support element similar to the other two support elements 35, 36, or a spring element connecting the one of the first mooring unit 40 and the second mooring unit 50 to which it is attached, with the support frame 31, or any other suitable means capable of providing stiffness and preferably damping of the support frame 31 relative to the one of the first mooring unit 40 and the second mooring unit 50 to which it is attached, in a third independent rotational degree of freedom.

The mooring frames 26, 27 should allow for torsional movement of the first mooring unit 40 or within the first mooring unit 40 so that the floating unit 10 can be allowed to rotate about a longitudinal axis passing through the first mooring unit 40. This rotational freedom about the longitudinal axis of the first mooring unit 40 may be obtained by employing a joint element 20 that allows rotation of the first mooring unit 40 about the longitudinal axis, i.e. the joint element 20 allows rotation of the first mooring unit 40 about three independent axes relative to the support member 19. The joint element 41 may then be chosen to allow rotation about two independent axes only which are independent of (i.e. not parallel to) the longitudinal axis of the first mooring unit. The longitudinal axis of the first mooring unit 40 is the axis that passes through the joint elements 20 and 41 in the drawings.

An alternative would be to employ a joint element 41 that allows rotation of the attachment unit about the longitudinal axis, i.e. the joint element 41 allows rotation of the attachment unit 30 about three independent axes relative to the first mooring unit 40. The joint element 20 may then be chosen to allow rotation about two independent axes only which are independent of (i.e. not parallel to) the longitudinal axis of the first mooring unit.

Another option would be to provide the first mooring unit with a separate joint element (not shown in the figures) that would allow a first part of the first mooring unit 40 to rotate about the longitudinal axis relative to the remaining part of the first mooring unit 40. This may be achieved for example by allowing the piston 46 of the cylinder/piston assembly to rotate within the cylinder 42 or by employing a separate joint element (not shown in the figures), which may be attached for example to either end of the first mooring unit 40, that may be designed to allow rotation about the longitudinal axis only.

The first mooring unit 40, as described above, includes a cylinder/piston assembly. It is, however, not necessary to include the cylinder/piston assembly and instead use a beam or a truss element. This will be further described further down in connection with the description of FIGS. 11-14.

The mooring frames 26, 27 may also allow for torsional movement of the second mooring unit 50 or within the second mooring unit 50 so that the floating unit 10 can be allowed to rotate about a longitudinal axis passing through the second mooring unit 50. This rotational freedom about the longitudinal axis of the second mooring unit 50 may be obtained by employing a joint element 22 that allows rotation of the second mooring unit 50 about the longitudinal axis, i.e. the joint element 22 allows rotation of the second mooring unit 50 about three independent axes relative to the support member 21. The joint element 51 may then be chosen to allow rotation about two independent axes only which are independent of (i.e. not parallel to) the longitudinal axis of the second mooring unit. The longitudinal axis of the second mooring unit 50 is the axis that passes through the joint elements 22 and 51 in the drawings.

An alternative would be to employ a joint element 51 that allows rotation of the second mooring unit 40 about its longitudinal axis, i.e. the joint element 51 allows rotation of the attachment unit 30 about three independent axes relative to the second mooring unit 50. The joint element 22 may then be chosen to allow rotation about two independent axes only which are independent of (i.e. not parallel to) the longitudinal axis of the second mooring unit.

Another option would be to provide the second mooring unit 50 with a separate joint element (not shown in the figures) that would allow a first part of the second mooring unit 50 to rotate about the longitudinal axis relative to the remaining part of the second mooring unit 50. This may be achieved for example by allowing the piston 55 of the cylinder/piston assembly to rotate within the cylinder 52 or by employing a separate joint element (not shown in the figures), which may be attached for example to either end of the second mooring unit 50, that may be designed to allow rotation about the longitudinal axis only.

In FIGS. 11-14 a slightly different embodiment of the present invention is shown. In this embodiment, the first mooring unit 40 of the first and second mooring frames 26, 27 are provided with a beam or truss element. As compared to the first mooring units described above, the first mooring unit 40 of the embodiment shown in FIGS. 11-14 does not comprise the cylinder/piston assembly for transferring forces and/or absorbing energy arising from relative motions between the floating unit 10 and the floating or non-floating structure to which the floating unit 10 is attached.

The first mooring unit 40 comprises, as shown in the FIGS. 11-14, a truss element 76. A simpler beam element may also be used instead of the truss element 76. The truss element 76 is provided with an attachment member 77 at one end. To the attachment member 77 the support frame 31 of the attachment unit 30 is attached with the joint element 22 as explained in detail above. Furthermore, the first support element 35 and the second support element 36 are also attached to the attachment member 77 with respective joint elements 37 in one end and to the attachment frame 31 with respective joint elements 37 at the other end as explained in detail above. The piston 55 of the second mooring unit 50 is preferably also attached to the attachment member 77 with the joint element 51 as explained in detail above. The attachment member 77 may simply be an end portion of the truss element 76 or may be a separate element, as indicated in the FIGS. 11-14, which is secured to the truss element 76, for example by welding.

In the other end of the truss element 76 it is attached to the first support member 19 with a joint element 20 as described above. The frame support unit 58 comprises a cylinder 60 which is attached to the third support member 23 with the joint element 24 in one end as described above, and a piston 63, which is movably arranged in the cylinder 60, which is attached to a joint element support 78 on the truss element 76 with the joint element 59 in a similar way as described above.

This embodiment does not provide the same flexibility and ability to absorb energy as the embodiment of the first mooring unit 40 including a cylinder/piston assembly, but may in certain situations be sufficient.

The invention has now been explained with reference to non-limiting examples. A person skilled in the art will appreciate that modifications and changes may be made to these embodiment which will be within the scope of the invention as defined in the following claims.

The invention claimed is:

1. A mooring frame for mooring of a floating unit, the mooring frame being adapted for mounting on the floating unit or a floating or non-floating structure and comprising an attachment unit for attachment to the floating unit or the floating or non-floating structure, the mooring frame further comprising:

a first mooring unit for transferring forces and/or absorbing energy in a first direction, a second mooring unit for transferring forces and/or absorbing energy in a second direction which is at least partially perpendicular to the first direction, wherein the first mooring unit and the second mooring unit are attached to each other with a first joint element which allows relative rotation about two or three independent axes, the attachment unit is attached to the mooring frame with a second joint element which allows relative rotation about two or three independent axes, the first mooring unit is adapted to be attached to the floating unit or the floating or non-floating structure with a third joint element which allows relative rotation about two or three independent axes, and the second mooring unit is adapted to be attached to the floating unit or the floating or non-floating structure with a fourth joint element which allows relative rotation about two or three independent axes, wherein at least one of the third joint element and the second joint element allows torsional movement of the first mooring unit relative to the floating unit or the floating or non-floating structure, or torsional movement is allowed within the first mooring unit itself, and wherein at least one of the fourth joint element and the first joint element allows torsional movement of the second mooring unit relative to the floating unit or the floating or non-floating structure, or torsional movement is allowed within the second mooring unit itself.

2. Mooring frame according to claim 1, wherein the mooring frame further comprises a frame support unit which is connected to the first mooring unit or the second mooring unit with a joint element.

3. Mooring frame according to claim 1 or 2, wherein the first mooring unit and/or the second mooring unit and/or the frame support unit comprise a spring element and/or a shock damper element.

4. Mooring frame according to claim 1, wherein the frame support unit comprises a winch with a winch wire.

5. Mooring frame according to claim 1, wherein the first mooring unit and/or the second mooring unit and/or the frame support unit comprise a cylinder and a piston movably arranged in the cylinder.

6. Mooring frame according to claim 1, wherein the attachment unit comprises a support frame and at least one attachment element mounted to the support frame with a joint element which allows the at least one attachment element to rotate about two or three independent axes relative to the support frame.

7. Mooring frame according to claim 6, wherein the attachment unit comprises a fender that limits the movement of the at least one attachment element relative to the support frame.

8. Mooring frame according to claim 1, wherein the mooring frame further comprises at least one support element for damping of movements of the attachment unit relative to the first mooring unit, the at least one support element being connected to the attachment unit with a joint element and to the first mooring unit with a joint element.

9. Mooring frame according to claim 8, wherein the at least one support element for the attachment unit comprises a spring element and/or a damper element, or is hydraulically operated.

10. Mooring frame according to claim 8, wherein the at least one support element for the attachment unit comprise a cylinder and a piston movably arranged in the cylinder.

11. Mooring frame according to claim 1, wherein the attachment unit comprises an independent shock absorbing element for absorbing impact energy during attachment of the attachment elements to an outer surface of the floating or non-floating structure.

12. Mooring frame according to claim 1, wherein the first mooring unit is adapted to be further connected to a structure that the mooring frame is being mounted on with a joint element which allows the first mooring unit to rotate about two or three independent axes relative to the structure.

13. Mooring frame according to claim 1, wherein the second mooring unit is adapted to be further connected to a structure that the mooring frame is being mounted on with a joint element which allows the second mooring unit to rotate about two or three independent axes relative to the structure.

14. Mooring frame according to claim 1, wherein the frame support unit is adapted to be further connected to a structure that the mooring frame is being mounted on with a joint element which allows the frame support unit to rotate about two or three independent axes relative to the structure.

15. Mooring frame according to claim 1, wherein the mooring frame comprises at least one buoyancy element which is mounted to the attachment unit and/or the first mooring unit and/or the second mooring unit.

16. Mooring frame according to claim 1, wherein the joint elements comprise a universal joint or a ball joint.

17. A floating uni comprising at least one mooring frame according to claim 1 for mooring the floating unit to a floating structure or to a non-floating structure.

18. Floating unit according to claim 17, wherein the floating unit comprises at least one first support member comprising a joint element to which the first mooring unit of the at least one mooring frame is attached, the joint element allowing the first mooring unit to rotate about two or three independent axes relative to the at least one first support member.

19. Floating unit according to claim 17, wherein the floating unit comprises at least one second support member comprising a joint element to which the second mooring unit of the at least one mooring frame is attached, the joint element allowing the second mooring unit to rotate about two or three independent axes relative to the at least one second support member.

20. Floating unit according to claim 17, wherein the floating unit comprises at least one third support member comprising a joint element to which the frame support unit of the at least one mooring frame is attached, the joint element allowing the frame support unit to rotate about two or three independent axes relative to the at least one third support member.

* * * * *